US008424276B2

(12) United States Patent
Krause

(10) Patent No.: US 8,424,276 B2
(45) Date of Patent: Apr. 23, 2013

(54) PRODUCT MULTI-PACK

(76) Inventor: Andrew Krause, Farmington Hills, MI (US)

( * ) Notice: Subject to any disclaimer, the term of this patent is extended or adjusted under 35 U.S.C. 154(b) by 0 days.

(21) Appl. No.: 13/460,057

(22) Filed: Apr. 30, 2012

(65) Prior Publication Data

US 2012/0211393 A1 Aug. 23, 2012

Related U.S. Application Data

(63) Continuation of application No. 12/424,139, filed on Apr. 15, 2009, now abandoned.

(51) Int. Cl.
*B65B 5/06* (2006.01)

(52) U.S. Cl.
USPC ..... 53/544; 53/48.3; 53/49; 53/158

(58) Field of Classification Search ..... 53/544, 53/48.3, 48.4, 48.9, 49, 158, 539, 542, 543
See application file for complete search history.

(56) References Cited

U.S. PATENT DOCUMENTS

| | | | | | |
|---|---|---|---|---|---|
| 2,807,404 | A | * | 9/1957 | Cote | 206/591 |
| 3,404,505 | A | * | 10/1968 | Hohl et al. | 53/398 |
| 3,415,350 | A | * | 12/1968 | Murphy | 198/394 |
| 3,541,751 | A | * | 11/1970 | Quebe et al. | 53/398 |
| 3,580,380 | A | * | 5/1971 | Phillips | 198/376 |
| 3,742,677 | A | * | 7/1973 | Best | 53/398 |
| 3,826,060 | A | * | 7/1974 | Vergobbi | 53/48.4 |
| 3,870,221 | A | * | 3/1975 | Zeitter | 229/162.7 |
| 3,877,198 | A | * | 4/1975 | Vergobbi | 53/48.5 |
| 4,051,366 | A | * | 9/1977 | Gordon | 250/223 B |
| 4,231,209 | A | * | 11/1980 | Walker et al. | 53/48.1 |
| 5,215,180 | A | * | 6/1993 | Allard et al. | 198/395 |
| 5,321,935 | A | * | 6/1994 | Spatz et al. | 53/490 |
| 5,813,193 | A | * | 9/1998 | Chan et al. | 53/398 |
| 5,919,028 | A | * | 7/1999 | Edqvist | 414/754 |
| 6,868,652 | B2 | * | 3/2005 | Arends et al. | 53/446 |
| 6,932,265 | B2 | * | 8/2005 | Sax et al. | 229/122 |
| 2010/0192515 | A1 | * | 8/2010 | Chalendar et al. | 53/396 |

FOREIGN PATENT DOCUMENTS

| | | | | |
|---|---|---|---|---|
| GB | 2035959 | A | * | 6/1980 |
| JP | 2002337928 | A | * | 11/2002 |
| JP | 2004106933 | A | * | 4/2004 |

* cited by examiner

*Primary Examiner* — Hemant M Desai
(74) *Attorney, Agent, or Firm* — Oakland Law Group PLLC

(57) ABSTRACT

A product multi-pack is provided with a plurality of elongate product containers. The containers each include a bottom, an open top that is closed by a cap and a wall extending there between. The wall includes a label having a front portion extending about a limited section of the wall circumference. A carton is provided that is sized to display the plurality of product containers. A locator web is provided that is formed of a thin sheet of plastic having a plurality of spaced apart apertures. The apertures are sized to be at least partially elastically deformed when installed over the caps of the product containers. Additionally, the locator web provides frictional resistance to rotation of the product containers, which enables the containers to be positioned and held in place relative to the carton open face so that the label front portions are visible.

16 Claims, 5 Drawing Sheets

PRODUCT MULTI-PACK

CROSS-REFERENCE TO RELATED APPLICATION

This application is a continuation of prior application Ser. No. 12/424,139, filed Apr. 15, 2009 now abandoned which is hereby incorporated by reference in its entirety.

BACKGROUND

1. Technical Field

One or more embodiments of the present invention generally relate to a product multi-pack for securing a plurality of oriented containers relative to each other and for displaying the containers at a point of purchase.

2. Background Art

Container connectors for attaching a plurality of beverage containers, such as beer or soft drink cans, are well known. Such connectors are typically thin flexible sheets of plastic that include a series of apertures. Each aperture is sized for receiving a portion of the can. For example, common "six-pack" connectors include six apertures that are each engageable about an upper ridge of a can. Similar connectors have been used to hold bottles, and non fluid containers.

Container positioners have been incorporated into cardboard cartons, such as those currently used to display two ounce bottles of 5-hour ENERGY® dietary supplements. Such container positioners include a cardboard panel having a series of apertures. Each aperture receives a cap of a bottle. The apertures provide frictional resistance that opposes the rotation of the bottles. The carton also includes a window to display the bottles. Once the bottles are placed in the carton, and are engaged by the panel, they may be manually rotated to orient the bottle labels such that they are facing out of the window.

SUMMARY OF THE INVENTION

In at least one embodiment a product multi-pack is provided with a plurality of elongate product containers. The containers each include a bottom, an open top that is closed by a cap and a wall extending there between. The wall includes a label having a front portion extending about a limited section of the wall circumference. A carton is provided that is sized to display the plurality of product containers retained therein. A locator web is provided that is formed of a thin sheet of plastic having a plurality of spaced apart apertures formed therein. The apertures are sized to be at least partially elastically deformed when installed over the caps of the product containers. Additionally, the locator web provides frictional resistance to rotation of the product containers, which enables the containers to be positioned and held in place relative to the carton open face so that the label front portions are visible.

In another embodiment, a method of packaging at least two of generally circumferentially symmetrically shaped product containers provided with a label having a front portion extending about a limited section of the circumference in an open face carton is provided. The method includes inserting an end of each of at least two product containers into one of a plurality of spaced apart apertures in a plastic web. Additionally the method includes optically sensing the orientation of the product containers. The method provides automatically rotating the product containers to a desired position based on the sensed orientation and the location of the label front portion. The method also includes enclosing the at least two product containers and the interconnecting plastic web into an open face multi-pack carton so that the label front portions of the plurality of product containers are oriented to be visible through the carton open face.

DETAILED DESCRIPTION

Figure 1:
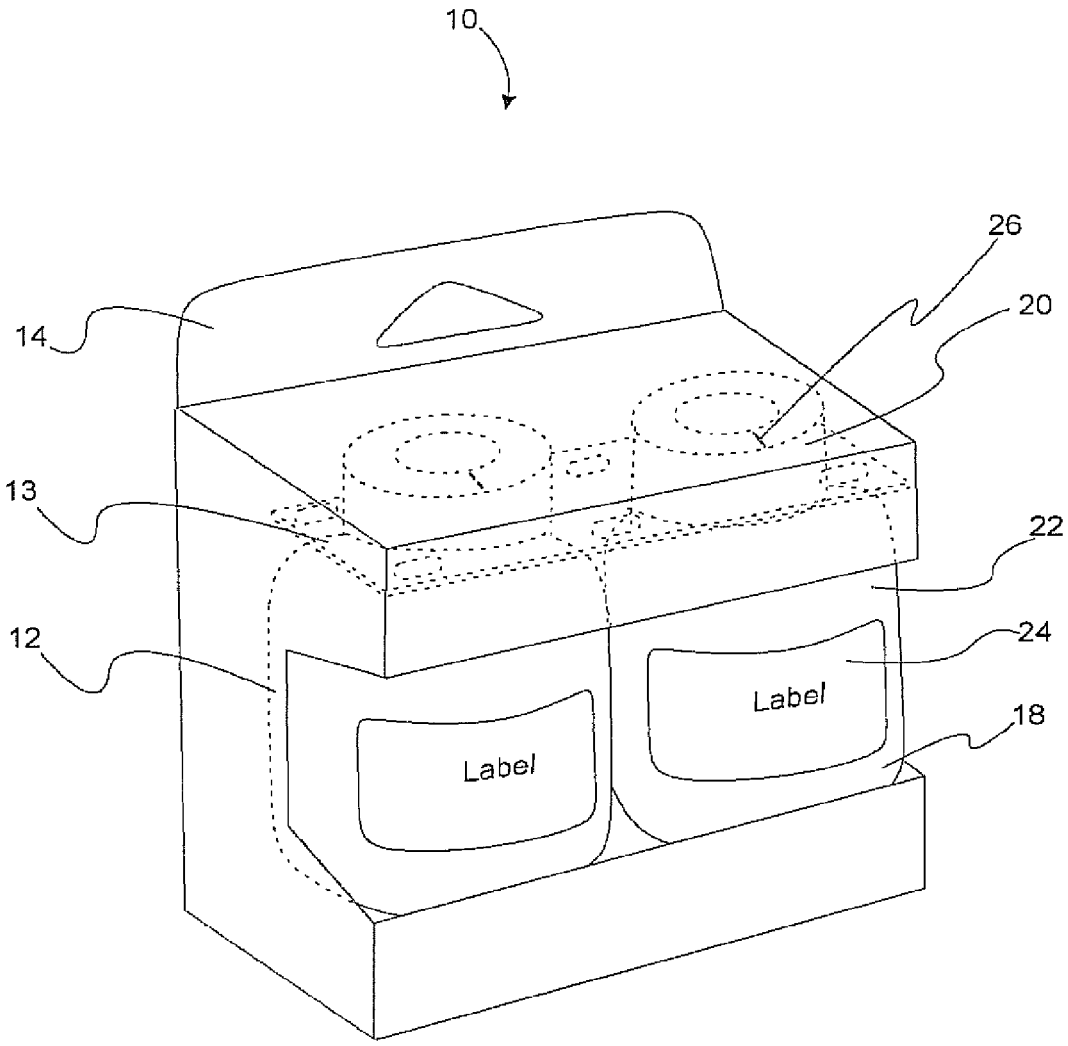
FIG. 1 is a side perspective view of a product multi-pack according to an embodiment of the present invention.

FIG. 1 illustrates a product multi-pack for securing and displaying product at a point of purchase, and is generally referenced as numeral 10. A product multi-pack 10 of the illustrated embodiment includes a pair of product containers 12, a web 13 and a carton 14 coupled to each other.

The product containers 12 are elongate containers that are sized for enclosing a consumable product. The containers 12 may be blow molded and generally cylindrical in shape. The web 13 is a thin sheet of elastic material that attaches a pair of containers 12 together. The web 13 is sized for receiving a portion of each of the containers 12, and provides a frictional resistance that opposes rotation of the container 12 relative to the web 13. The carton 14 supports and displays the pair of containers 12 at the point of purchase.

Figure 2:
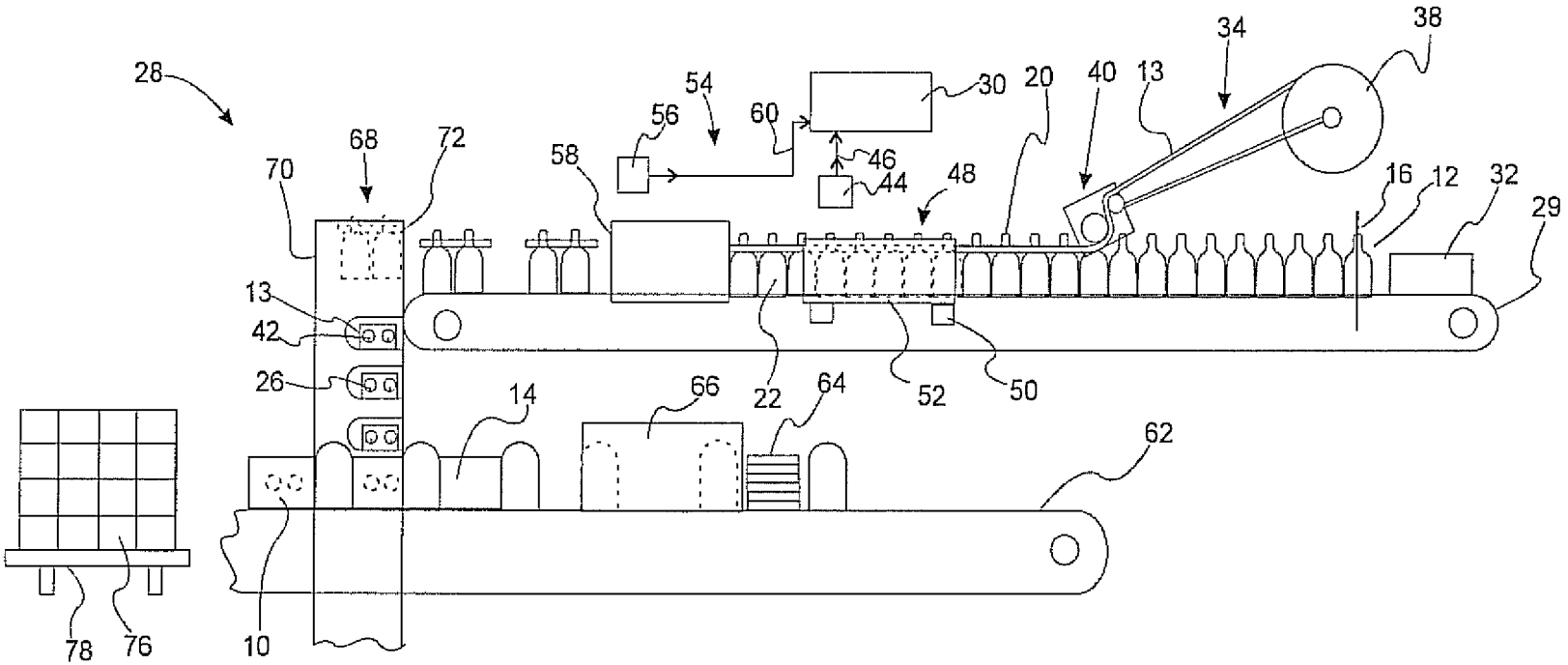
FIG. 2 is a side elevation view of a system for packaging a product multi-pack according to another embodiment of the present invention.

The containers 12 are circumferentially symmetrical about a vertical axis 16 (FIG. 2). Alternate embodiments envision containers having other shapes such as spherical or an "hourglass". The containers 12 include a bottom region 18 for resting upon an underlying surface. The containers 12 also include a re-closeable top 20. A tubular wall 22 extends between the bottom 18 and top 20 of each container 12. A label 24 is disposed over a limited section of the circumference of the wall 22. The label 24 includes a logo for the product, such as the 5-hour Energy® logo. The containers 12 are oriented such that the labels 24 are both facing the same direction.

An indicator 26 is provided on the exterior of the container 12, for indicating a rotational position of the label 24 relative to the current position of the container 12. For example the indicator 26, may be a marking on the top 20 that correlates to a lateral edge or seam of the label 24. Alternatively the indicator 26 may be a lateral marking, edge, seam or an image on the label 24 itself. Another embodiment of the indicator 26 envisions an indentation (not shown) on the bottom region 18, that correlates to a label 24 position.

Referring to FIG. 2, a system 28 is provided for orienting and packaging the product multi-pack 10. The system 28 includes a first conveyor belt 29 for conveying the product containers 12 through a series of stations. Each station contributes to the overall packaging and orienting of the product containers 12. The conveyor 29 is configured to generally convey the containers 12 in a linear direction. Alternate embodiments of the conveyor 29 envision conveying the containers in a non linear direction, or linear with curved portions.

A controller 30 is provided for communicating with the series of stations of the system 28. The controller 30 generally includes any number of microprocessors, ASICs, ICs, memory (e.g., FLASH, ROM, RAM, EPROM and/or EEPROM) and software code to co-act with one another to communicate with the stations of system 28. The controller 30 is configured for receiving signals from the series of stations, indicating various aspects of the individual stations as the containers 12 are conveyed along the system 28. The controller 30 is also configured for analyzing the received signals, and transmitting signals/commands back to the stations.

The system 28 includes a feed station 32 for controlling the flow of the conveyed product containers 12. The feed station 32 receives a plurality of product containers 12, each positioned in a generally upright orientation. The feed station 32 is coupled to the conveyor 29, such that the feed station 32 controls the width and longitudinal spacing of the conveyed containers 12. The feed station 32 controls the width of the conveyed containers 12 by funneling the containers 12 into a pre determined lateral spacing. For example, the feed station 32 may only permit the containers 12 to proceed in a single file line along the conveyor 29. Alternate embodiments of the feed station 32 envision the station 32 grouping the product containers 12 side by side, with multiple containers 12 (e.g. two or three) laterally aligned on the conveyor 29. Additionally, the feed station controls the longitudinal spacing, such that there generally is no space between consecutive containers 12.

The system 28 also includes a web application station 34. At the web application station 34, the elongate plastic web 13 is installed over the laterally aligned series of conveyed containers 12. The web 13 attaches the containers 12 to each other. The web application station 34 includes a drive sprocket (spool) 38 for the web 13 to be wound upon. The spool 38 is positioned above the conveyor 29, such that the web 13 extends downward from the spool 38 to longitudinally align with the conveyed containers 12. The web application station 34 also includes an applicator mechanism 40 having multiple small spools for installing the web 13 to each container 12.

The web 13 is a thin elongate strip of flexible elastically deformable plastic. The web 13 is provided with a series of apertures 42 projecting through the thickness of the web 13. Each aperture 42 is sized for receiving an outer diameter of the top 20 of the container 12. The web 13 elastically deforms around each aperture 42 to conform to and frictionally engage the top 20 of each container 12. The apertures 42 are generally centrally oriented about a width of the web 13, and longitudinally aligned about a length of the web 13.

The system 28 includes a rotation sensor 44, that is configured for measuring the rotational position of each product container 12, after the web 13 is installed. The sensor 44 detects the indicator 26 on the container 12 and takes a measurement of the position of the indicator 26 relative to a pre-determined coordinate system to measure the rotational position of each container 12. The sensor 44 transmits a rotation signal 46 corresponding to the position of each container 12, to the controller 30. The pre-determined coordinate system may be a 360 degree polar coordinate system centered about the vertical axis 16 of each container 12. It is generally recognized that other sensors/measuring devices may be used. The particular type of measuring device that is implemented may vary based on the desired criteria of a particular implementation.

The controller 30 receives the rotation signal 46 from the sensor 44. The controller 30 may include signal conditioning equipment (not shown) for adjusting and digitizing any such received signals. The controller 30 accesses and analyzes the digitized signals. The controller 30 may assign an incremental number to the signal 46, to associate each received signal 46 to a corresponding container 12. Thus the controller 30 may track the rotational position of each container 12.

An alignment station 48 receives each container 12. The alignment station 48 includes a pair of drive members 50 that upwardly extend from fixtures (not shown) positioned on opposing sides of the conveyor 29. Each drive member 50 operates a rotating belt 52 that tangentially contacts the wall 22 of each of a series of conveyed containers 12. The pair of belts 52 are transversely spaced apart and generally aligned parallel to each other. The pair of drive members 50 are configured such that their respective belts 52 frictionally engage opposing walls 22 of the conveyed containers 12. The belts 52 may be sized to simultaneously engage three consecutive conveyed containers 12.

The controller 30 independently controls the speed of each drive member 50, to selectively rotate the containers as they translate through the alignment station 48. The controller 30 may allow the containers to translate through the alignment station, without rotating relative to the web 13, by commanding the drive members 50 to drive the belts 52 at the same tangential velocity. Additionally, the controller 30 may rotate the containers 12 about their respective axis 16 and relative to the web 13, by commanding the drive members 50 to operate the belts 52 at different tangential velocities. The controller 30 is programmed with pre-determined data regarding the desired rotational position of each container 12 once it exits the alignment station 48.

A cutting station 54 receives the series of connected and oriented conveyed containers 12 from the alignment station 48, and separates them into subassemblies of linked containers 12. For example the cutting station 54 of the illustrated embodiment separates the containers 12 into subassemblies of two linked containers 12. The cutting station 54 includes a feed sensor 56 and a transverse cutting mechanism 58 operatively coupled to each other. The sensor 56 measures the longitudinal position of the containers 12 and transmits a corresponding feed signal 60 to the controller 30. The feed sensor 56 may be a laser sensor that is positioned to indicate the presence of a container 12. It is generally recognized that other sensors/measuring devices may be used. The particular type of measuring device that is implemented may vary based on the desired criteria of a particular implementation. The controller 30 analyzes the signal 60 and commands the cutting mechanism 58 to actuate and transversely cut the web 13 thereby separating the series of containers 12 into subassemblies of linked containers 12.

The system 28 includes a carton conveyor line 62 that is positioned adjacent to the first conveyor 29. The carton conveyor 62 receives a plurality of carton blanks 64. The conveyor 62 passes the blanks 64 through a series of carton erecting stations 66 to erect the carton 14. The carton 14 is positioned for receiving a subassembly of linked containers 12.

The first conveyor 29 includes a transfer station 68 for individually transferring subassemblies of linked containers 12 to the carton conveyor line 62. The transfer station 68 includes a transverse dial 70 for receiving linked containers 12. The dial 70 is transversely aligned relative to the longitudinal length of the first conveyor 29. The dial 70 rotates about an axis (not shown) that is positioned below an upper planar surface of the conveyor 29, such that a portion of the circumferential edge of the dial 70 extends above the conveyor 29. A series of pockets 72 are formed within the portion of the circumferential edge of the dial 70. The pockets 72 are sized for receiving the linked containers 12. At a first dial position, the pocket 72 receives the linked containers 12. The controller commands the dial 70 to rotate from the first dial position to a second dial position. An ejection system (not shown) is coupled to the dial 70, for ejecting the linked containers 12 at the second dial position. The linked containers 12 are ejected from the second dial position, and received by the carton 14 of the carton conveyor line 62.

An opened carton 14 is positioned on the carton conveyor line 62 to receive the linked containers 12 and proceeds to complete the packaging process. After receiving the containers 12 within the open carton 14, the conveyor line 62 closes the carton 14 to form a multi-pack 10. The carton conveyor line 62 may include additional stations for packaging an assortment of multi-packs 12 within a box 76, and palletizing a plurality of boxes on a pallet 78.

Alternate embodiments of the system 28, envision the addition of a leak test station (not shown) for detecting defective containers. Such a leak test station may be coupled to the conveyor 29, upstream of the feed station 32. A leak test station would squeeze containers 12 for detecting fractures or improper product volumes within the containers 12.

Figure 3:
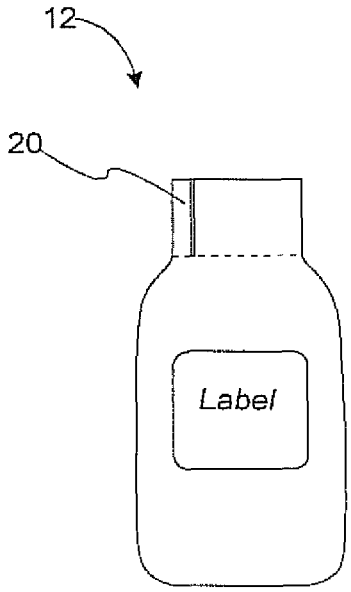
FIG. 3 is an enlarged side elevation view of a product container of FIG. 1.
Figure 4:
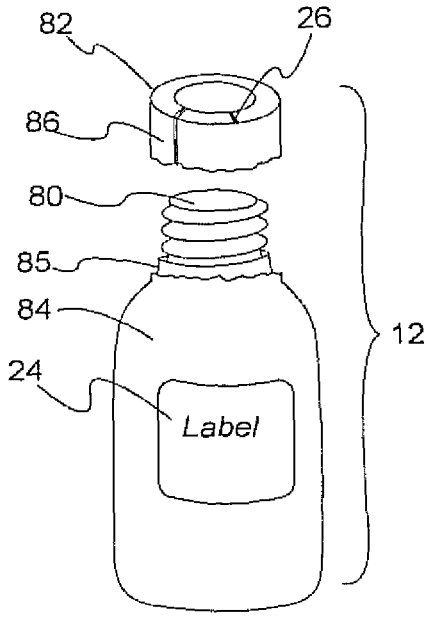
FIG. 4 is an enlarged side perspective view of the product container of FIG. 1, illustrated with a removable top.

Regarding FIGS. 3-4, the container 12 is provided with the re-closeable top 18, so that a user may open the top 18, consume some of the product inside, then re-close the top 18. The container 12 includes an opening 80 and a cap 82 that are operatively coupled to each other. For example the opening 80 may be an externally threaded neck, and the cap 82 may include internal threads (not shown).

The container 12 is sized for enclosing a nominal volume of fluid, such as 2 fluid ounces. Alternate embodiments envision containers for enclosing solid products such as medicine or vitamins. Additional alternate embodiments envision containers for larger volumes of fluid, such as 4 or 6 ounces.

A shrink wrap plastic coveting 84 is disposed over a substantial portion of the outer circumference of the container 12 and acts as a seal. The covering 84 axially extends along the wall 22 of the container 12 to partially cover the cap 82. The covering 84 includes a pair of perforated regions that act as a seal for the container 12, by both preventing the cap 82 from inadvertently unscrewing and also for visually indicating to a user that the cap 82 had previously been unscrewed or "tampered with". A perforated ring 85 extends along the circumference of container 12 at the base of the cap 82. A tear strip 86 extends from the ring 85 to an edge of the covering 84 on the top of the cap 82. To open a container 12, a user may remove the tear strip 86, then unscrew the cap 82, which breaks the perforated ring 85. The coveting 84 may include the label 24 formed within, or the covering 84 may be generally transparent and formed over the label 24. Alternate embodiments of the container 12, envision a seal, comprised by a 2-piece cap assembly (not shown), whereby a lower ring is detached from the cap during the first time the seal is broken. Such a seal is commonly used in the soft drink industry.

Figure 5:
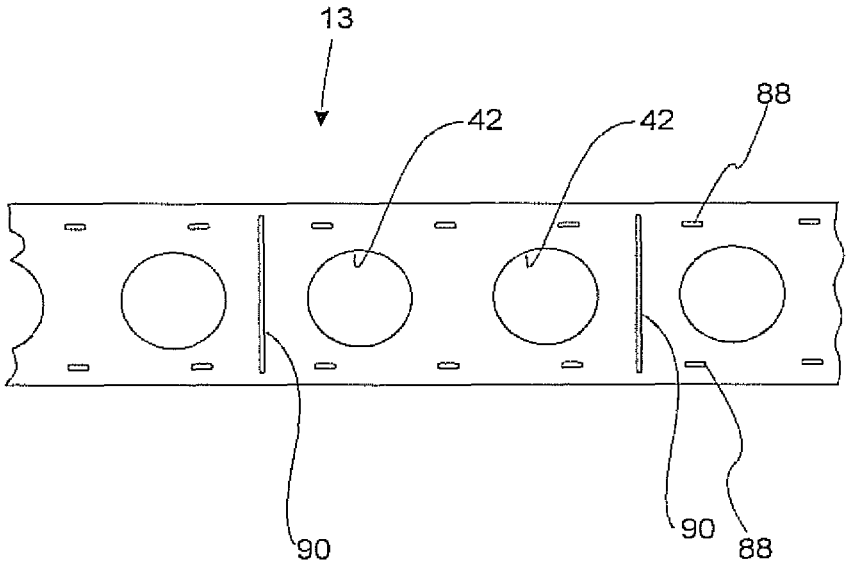
FIG. 5 is a top plan view of an elongate web member for receiving the product container of FIG. 3.

With respect to FIG. 5, the web 13 is made of a thin elastic polymer that is sized for receiving the containers 12. The web 13 may be formed of an elastic polymer such as polyethylene (PE) or polypropylene (PP) or low density polyethylene (LDPE). The web 13 includes the series of apertures 42 for receiving the caps 82 (FIGS. 3-4) of the containers 12. The outer diameter of the cap 82 is generally larger than the inner diameter of the aperture 42, thereby providing an interference fit. The web 13 elastically deforms to receive the cap 82 of the container 12. The cap/web interface provides a frictional resistance that opposes the rotation and translation (pull-out) of the container 12 relative to the web 13. The frictional resistance helps maintain the oriented position of the containers 12. For example, an interference fit may be provided by a web 13 having apertures 42 with inner diameters of 0.812 inches, that are sized to receive containers 12 having caps 82 with outer diameters of 0.895 inches.

The web 13 includes a series of pairs of perforations (perf-pairs) 88 for maintaining tension within the web 13 during application of the web 13 to the containers 12. The perf-pairs 88 are transversely spaced apart pairs of slots that are longitudinally spaced along the length of the web 13. The perf-pairs 88 are sized for receiving pins (not shown) that radially extend from the circumference of the spool 38 (FIG. 2), and also radially extend from the circumference of the small spools of the applicator 40 (FIG. 2).

The web 13 also includes a series of transverse slits 90 that assist the cutting station 54 (FIG. 2) in separating the series of containers 12 into subassemblies of linked containers 12. The slits 90 extend partially across the width of the web 13. However the slits 90 terminate short of the opposed transverse edges of the web 13. The width of the web 13 is approximately equal to the maximum diameter of the container 12. At the cutting station 54, the controller 30 commands the transverse cutting mechanism 58 to cut the web 13 at each slit 90, thereby separating the series of containers 12 into linked containers 12. In the illustrated embodiment, there are at least two apertures 42 and three pairs of perforations 88 between adjacent slits 90, therefore the cutting station 54 separates the series of containers 12 into subassemblies of two linked containers 12. The length of a portion of the web 13, after it is cut by the cutting station 54, is approximately equal to the maximum diameter of the container 12 multiplied by the number of containers 12 that are linked in the subassembly.

Figure 6:
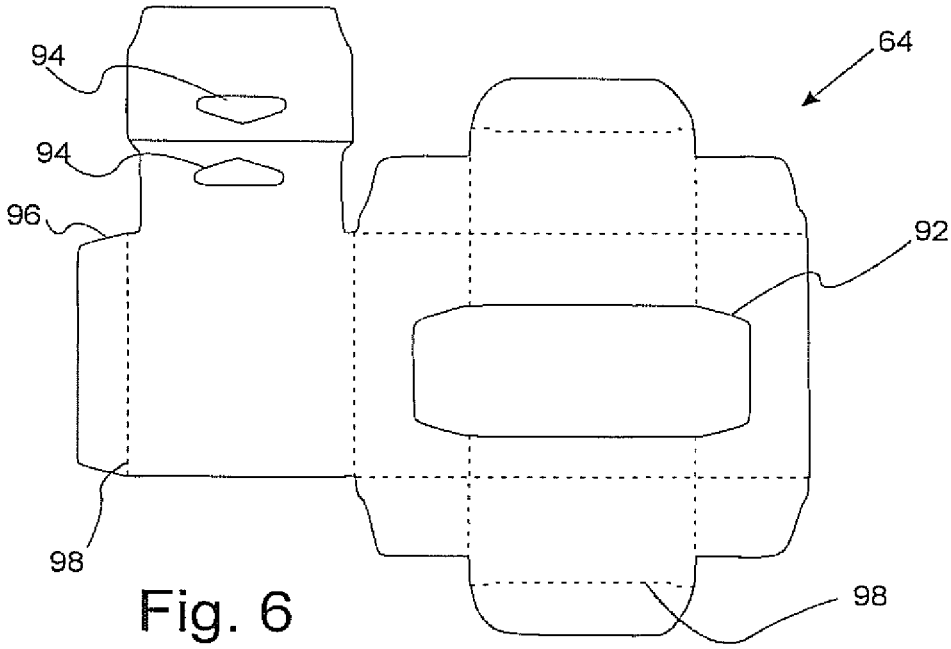
FIG. 6 is a side elevation view of a carton blank of FIG. 1.
Figure 7:
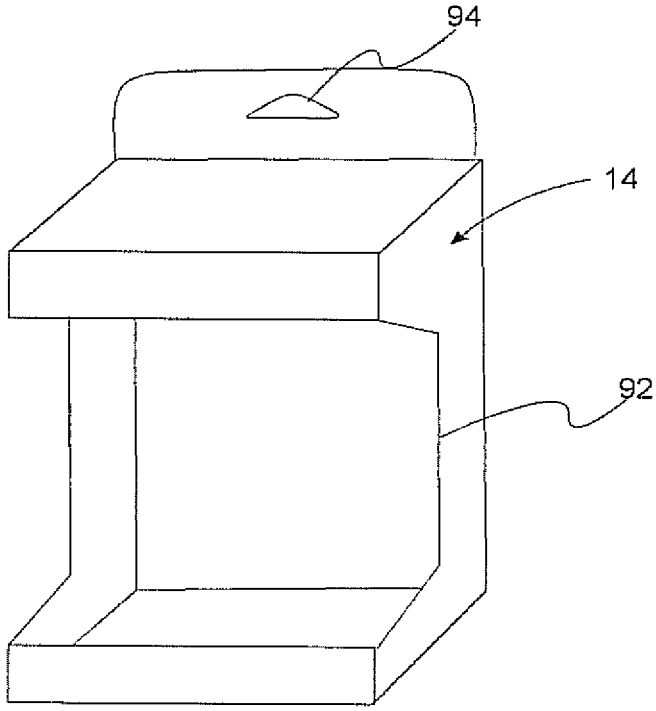
FIG. 7 is a side perspective view of a carton erected from the carton blank of FIG. 6.

Regarding FIGS. 6-7, a carton 14 is provided for supporting and displaying product containers 12 that are retained therein. A die-cut carton blank 64 may be formed from a sheet of cardboard. The blank 64 includes a window 92, a pair of hanger apertures 94, a glue tab 96 and a plurality of fold seams 98 formed therein. The blank 64 is erected into a carton 14 by the erecting stations 66 of the carton conveyor 62 (FIG. 2). The erecting stations 66 include equipment (not shown) to fold the blank 64 at the seams 98 and apply adhesive to the glue tab 96 to erect the carton 14. Once erected, the window 92 provides an internal view of the contents retained within the carton 14. For example, the containers 12 within the multi-pack 10, are externally displayed through the window 92. The pair of hanger apertures 94 are aligned during the erecting of the carton 14 to provide a location for receiving a post or hanger (not shown) for organizing the multi-packs 10 at the point of purchase. The blank 64 includes an assortment of additional sections that form the support structure of the carton including: a top, bottom, back and side walls.

Figure 8:
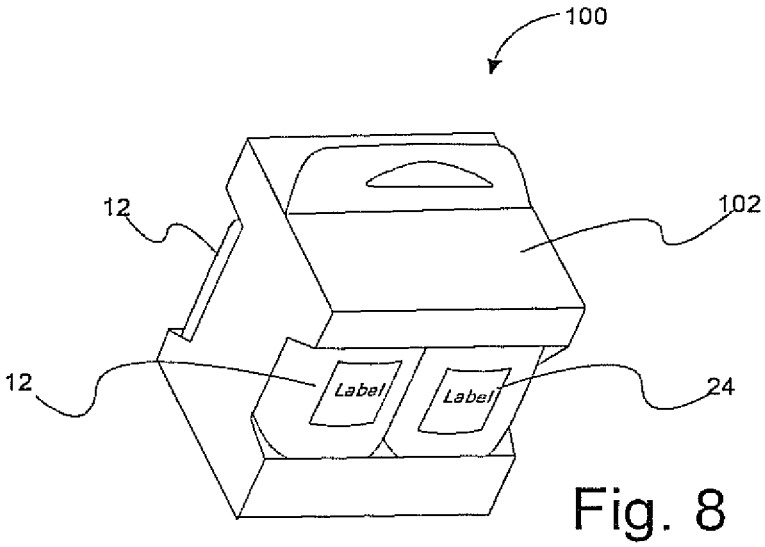
FIG. 8 is a top perspective view of a product multi-pack according to another embodiment of the present invention, illustrated with four product containers.
Figure 10:
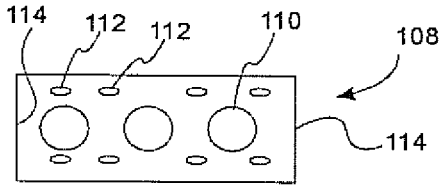
FIG. 10 is a top plan view of an elongate web member for receiving the products of the product multi-pack of FIG. 9.
Figure 9:
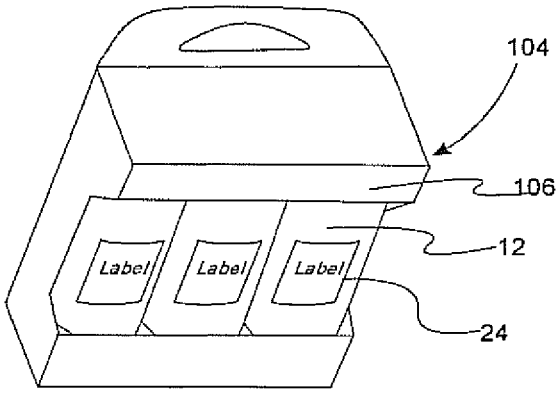
FIG. 9 is a top perspective view of a product multi-pack according to yet another embodiment of the present invention, illustrated with three product containers.

With reference to FIGS. 8-10, alternate embodiments of the product multi-pack 10 envision multi-packs of different quantities of containers 12. These alternate embodiments may include multiples of the two-pack configuration (e.g., four-packs, six-packs). Alternatively, embodiments contemplate a three-pack, or multiples thereof (e.g., six-packs, nine-packs). Still further embodiments envision combinations of two-packs with three-packs (e.g., five-packs and seven-packs).

FIG. 8 illustrates a Four-Pack 100 for supporting and displaying four containers 12. The Four-Pack 100 includes a dual window carton 102, having a pair of widows that open on opposite sides of the carton 102. Two pairs of containers 12 are retained within the Four-Pack 100. Each pair of containers 12 is connected by a web 13 (not shown). Each container 12 is oriented relative to its connected container 12, such that the labels 24 face in the same direction, outward of the carton 102.

FIGS. 9-10 illustrate a Three-Pack 104 for supporting and displaying three containers 12. The Three-Pack 104 includes a large window carton 106, having a large widow that extends along a side of the carton 106. Three containers 12 are retained within the Three-Pack 104. The containers 12 are connected by a three-web 108. The three-web 108 includes a series of apertures 110 for receiving the caps 82 (not shown) of the containers 12. The three-web 108 also includes a series of perf-pairs 112 for maintaining tension within the three-web 108 during application to the containers 12. The three-web 108 also includes a series of transverse slits 114 that assist the cutting station 54 (FIG. 2) in separating the series of containers 12 into linked sub-assemblies. In this embodiment, there are three apertures 110 and four pairs of perforations 112 between adjacent slits 114, therefore the cutting station 54 separates the series of containers 12 into subassemblies of three linked containers 12. Each container 12 is oriented relative to its connected containers 12, such that the labels 24 of the containers face the same direction outward of the carton 104.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention

What is claimed is:

1. A system for orienting and preparing labeled product containers for a product multi-pack, comprising;

a first conveyance means for conveying the labeled product containers;

a feed station coupled to said first conveyance means for controlling the flow of the labeled product containers along first said conveyance means;

a web application station for continuously applying a web to the labeled product containers, said web formed from a thin elastic polymer and comprising a plurality of apertures, transverse slits and perforations;

a rotation sensor for measuring the rotational position of the labeled product containers using at least one indicator on said labeled product containers to measure said rotational position;

a feed sensor for determining the longitudinal position of the labeled product containers;

an alignment station for selectively rotating the labeled product containers during continuous flow of the labeled product containers;

a cutting station for cutting said web at a predetermined length creating a predetermined set of labeled product containers joined by said web on the labeled product containers;

a transfer station for transferring the labeled product containers to a carton;

a carton erecting station for assembling said carton;

a second conveyance means to convey the cartons from said erecting station to said transfer station;

a controller that receives signals from said rotation sensor and said feed sensor for tracking and directing the position of each said labeled product container.

2. The system of claim 1 wherein said transfer station comprises a transverse dial that receives the product containers in a first position and rotates to a second position whereupon the product containers are ejected.

3. The system of claim 1 wherein said web application station comprises:

a drive sprocket positioned adjacent to said first conveyor for feeding said web; and an applicator mechanism for installing said web on the product containers.

4. The system of claim 1 wherein the diameter of said apertures of said web are less than the diameter of the cap of the product container.

5. The system of claim 1 wherein said web comprises perforations for cooperation with said drive sprocket.

6. The system of claim 1 wherein said alignment station comprises first and second drive members.

7. The system of claim 6 wherein said first and second drive members are positioned opposite each other and transverse to said first conveyance means.

8. The system of claim 7 wherein said first and second drive members each comprise a rotating belt, wherein said rotating belts frictionally engage opposing walls of the product containers.

9. The system of claim 7 wherein said first and second rotating belts contact up to three product containers simultaneously.

10. The system of claim 6 wherein said controller independently controls the speed of said first and second drive members to rotate the product containers.

11. The system of claim 1 wherein said rotation sensor measures the position of said indicator relative to a pre-determined co-ordinate system.

12. The system of claim 11 wherein said pre-determined co-ordinate system is a 360 degree polar co-ordinate system centered about each product container.

13. The system of claim 1 wherein said indicator is located on the cap of the product container.

14. The system of claim 1 wherein said indicator is located on the label of said product container.

15. The system of claim 1 wherein said indicator is an indentation on the bottom of the product container.

16. The system of claim 1 wherein said controller controls said alignment station to rotate the product containers.

* * * * *